US005487397A

United States Patent [19]

Bean

[11] Patent Number: 5,487,397

[45] Date of Patent: Jan. 30, 1996

[54] POOL BRUSH HYDROFOIL

[76] Inventor: Richard A. Bean, 7827 Midbury Dr., Dallas, Tex. 75230

[21] Appl. No.: 349,995

[22] Filed: Nov. 29, 1994

[51] Int. Cl.[6] ..... F04H 3/16

[52] U.S. Cl. ..... 134/6; 15/1.7; 15/160; 15/246

[58] Field of Search ..... 15/1.7, 160, 246; 134/6

[56] References Cited

U.S. PATENT DOCUMENTS

| | | | |
|---|---|---|---|
| 2,243,576 | 5/1941 | Otto | 15/160 |
| 3,003,168 | 10/1961 | Shouldice | 15/1.7 |
| 4,247,216 | 1/1981 | Pansini | 15/1.7 |
| 4,637,087 | 1/1987 | Feinberg | 15/1.7 |
| 4,733,427 | 3/1988 | Conrad | 15/160 |
| 4,742,592 | 5/1988 | Addona, Sr. | 15/1.7 |
| 4,783,868 | 11/1988 | O'Callaghan | 15/1.7 |
| 4,962,558 | 10/1990 | Harrell, Jr. | 15/160 |

*Primary Examiner*—Edward L. Roberts, Jr.
*Attorney, Agent, or Firm*—Richards, Medlock & Andrews

[57] ABSTRACT

A hydrofoil (10) is disclosed for attachment to a pool brush (12) to facilitate cleaning the side walls of a pool. The hydrofoil is pivotally attached to the handle through a resilient clip (30) passing through a pair of opposed holes (24) in the hydrofoil (10) and received in matching engagement pin receiving apertures (48, 50) in a notch (46) in the hydrofoil (10). As the pool brush (12) is moved up and down along the side of the pool, the hydrofoil pivots and causes the water to force the pool brush against the side of the pool to facilitate cleaning.

9 Claims, 1 Drawing Sheet

POOL BRUSH HYDROFOIL

TECHNICAL FIELD OF THE INVENTION

This invention relates to the cleaning of a swimming pool and specifically to the use of a pool brush to scrape the walls and bottom of the pool.

BACKGROUND OF THE INVENTION

During maintenance of a pool, particularly in a ground home pool, it is often necessary to scrape the side walls and bottom of the pool with a brush to remove dirt or algae. The typical brush used for this procedure includes a long, manually extendable handle made of aluminum pipe and a detachable brush head which is attached at one end of the handle by a nylon fastener. Use of the brush is tedious because it requires the user to move the brush up and down along the vertical surface of the pool wall, while simultaneously urging the bristles of the brush against the wall with sufficient force to provide effective cleaning action. This is an awkward movement and leads to early fatigue.

Several attempts have been made in the prior art to redesign the pool brush to provide for reduced brushing effort. Examples are U.S. Pat. Nos. 4,742,592, 3,003,168, and 2,243,576. Each of these patents discloses the use of an attachment to a pool brush which assists in urging the bristles of the brush against the side wall while the brush is moved in an up and down motion. A portion of the energy exerted in this up and down motion is converted by this attachment to a force urging the bristles of the brush against the side wall, thereby reducing the effort necessary for cleaning.

These patents disclose devices which are too complicated and expensive for practical application in the pool industry. Therefore, a need exists for a better design which will clean the side walls and bottom of the pool with less effort and yet be inexpensive to manufacture and purchase and easy to install without tools and easy to use.

SUMMARY OF THE INVENTION

In accordance with one aspect of the present invention, an apparatus is provided for use on a pool brush. The pool brush has a handle with a pair of opposed holes formed therein and a pair of engagement pins extending through the opposed holes. The apparatus includes a hydrofoil having a leading edge and a trailing edge. The foil defines a notch to receive a portion of the handle and includes engagement pin receiving apertures receiving portions of the engagement pins therein. The foil is thus pivotally mounted on the pool brush.

In accordance with another aspect of the present invention, the notch is positioned near the leading edge of the hydrofoil. In accordance with another aspect, at least one of the aperture receiving portions extends to an opening in the foil permitting an object to be inserted in the aperture to move the engagement pin out of engagement with the hydrofoil to remove the hydrofoil from the pool brush. In accordance with another aspect, the pair of engagement pins are formed on a nylon piece having a first resilient arm and a second resilient arm, each of the resilient arms mounting one of the engagement pins.

In accordance with another aspect of the present invention, a method is provided for using a pool brush to clean the side walls of a pool. The pool brush includes a handle with a pair of opposed holes formed therein and a pair of engagement pins extending through the opposed holes. The method includes the step of fitting a portion of the handle into a notch on a hydrofoil and engaging the pair of engagement pins with engagement pin receiving apertures within the notch to pivotally mount the water foil on the pool brush. The method further includes the step of reciprocating the pool brush along the wall of the pool so that the hydrofoil is pivoted to create a force urging the pool brush against the side of the pool as the pool brush is moved to clean the pool.

BRIEF DESCRIPTION OF THE DRAWINGS

For a more complete understanding of the present invention and further advantages thereof, reference is now made to the following detailed description taken in conjunction with the accompanying drawings, in which.

DETAILED DESCRIPTION

Figure 1:
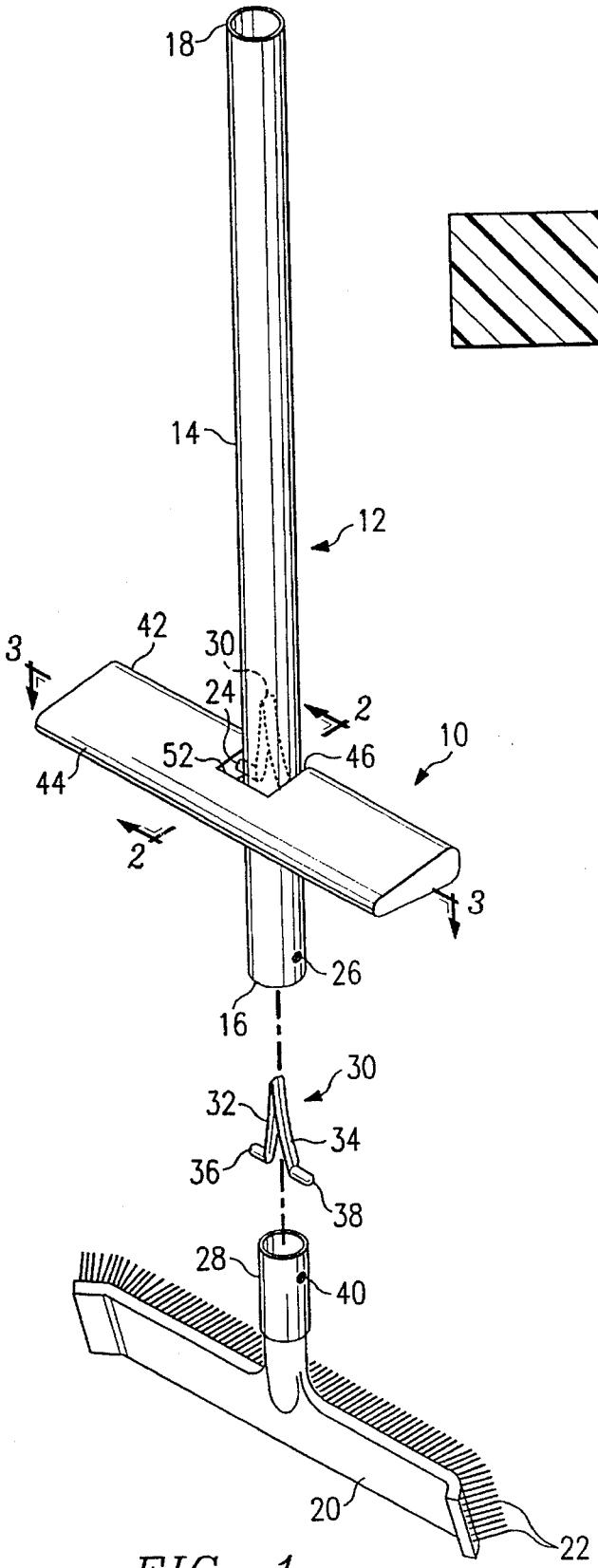
FIG. 1 is an exploded perspective view of a hydrofoil forming a first embodiment of the present invention mounted on a pool brush.
Figure 3:
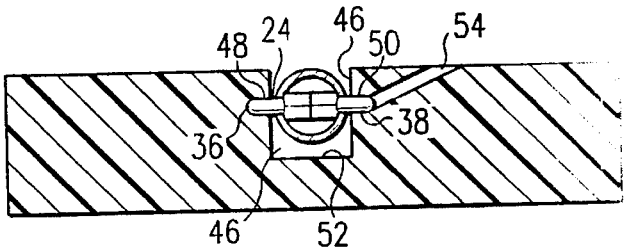
FIG. 3 is a cross-sectional view of the hydrofoil taken along line 3—3 in FIG. 1 illustrating it mounted to the pool brush.
Figure 2:
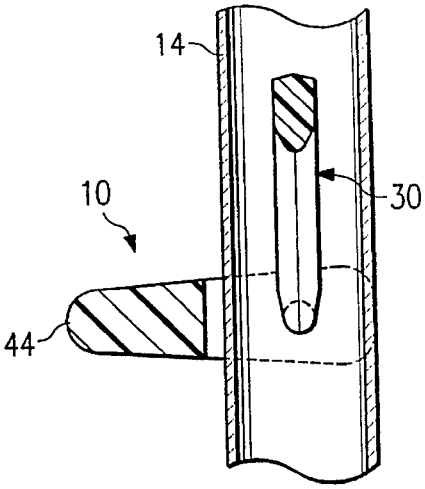
FIG. 2 is a vertical cross-sectional view taken along line 2—2 in FIG. 1 of a portion of the pool brush and the hydrofoil illustrating the resilient clip.

With reference now to the accompanying drawings, wherein like reference characters designate like or similar parts through the several views, a hydrofoil 10 is shown to be pivotally mounted on a pool brush 12 to assist a user in cleaning the bottom and side walls of a pool with less energy and fatigue.

The pool brush 12 is of a conventional design commonly found and includes a hollow aluminum handle 14 with a first end 16 and a second end 18. The handle 14 is often extendable to allow the brush to extend deep within the pool. At the first end 16 of the handle is mounted a brush head 20 with a series of bristles 22.

Almost invariably, the first end 16 of the handle 14 has two pairs of opposed holes 24 and 26 spaced at different distances from the first end 16. The brush head 20, in turn, typically includes a tubular portion 28 which will fit into the first end of the handle and mounts a resilient clip 30 having resilient arms 32 and 34. An engagement pin 36 is mounted at the end of resilient arm 32 while an engagement pin 38 is mounted at the end of resilient arm 34. Pins 36 and 38 will extend through opposed holes 40 in the brush head and will engage one of the pairs of holes 24 or 26 in the handle to lock the brush head 20 on the handle 14. To remove the brush head, all that is necessary is to push the engagement pins out of the holes in the handle through which they extend and the brush head 20 can simply be pulled out of the handle.

As described, when a brush head is mounted on the handle, the engagement pins engage only one of the pairs of holes 24 and 26 on the handle. As seen in the figures, the engagement pins of clip 30 engage the pair of holes 26.

The hydrofoil 10 is formed in a shape to define a leading edge 42 and a trailing edge 44. A notch 46 is formed through the leading edge and is sized to closely receive a portion of the handle 14 adjacent the second pair of holes 24. A resilient clip 30 is inserted into the first end of the handle so that the engagement pins 36 and 38 thereof extend out of the second holes 24. On opposite sides of the notch are an engagement pin receiving aperture 48 and an engagement pin receiving aperture 50. The apertures 48 and 50 receive the pins 36 and 38 respectively to pivotally mount the hydrofoil 10 on the handle 14. Hydrofoil 10 could be mounted on a resilient clip 30 at holes 26 as well. For example, the clip securing brush head 20 on the handle 14 could also secure hydrofoil 10 thereon. In such a case, it may be necessary to lengthen the engagement pins so they would pass through the brush and handle and into the receiving apertures of the hydrofoil.

As the brush is moved up and down along the side wall of the pool, the force of the water will pivot the hydrofoil 10 so that the trailing edge 44 is behind the leading edge 42 in the direction of motion of the brush. The pivoting motion of the hydrofoil will be limited by the engagement of the end 52 of the notch 46 with the handle. In this position, the flow of water over the hydrofoil 10 as the brush is moved will force the bristles of the brush into engagement with the side wall of the pool. Ideally, this will eliminate the need for the user to hold the bristles against the side wall and the user can simply brush by moving the handle in an up and down motion. When the motion of the brush is reversed, the hydrofoil 10 will simply pivot due to the force of the water in the opposite direction and provide a force to urge the bristles against the side of the pool as well.

The engagement pin receiving aperture 50 extends through the hydrofoil to open through an opening 54 on the leading edge of the hydrofoil 10 to permit a nail or other object to be inserted into the opening to deflect the engagement pin 38 out of the aperture 50 and permit the hydrofoil 10 to be removed from the handle. A spring loaded plunger or similar device can be permanently mounted in the hydrofoil to perform this function if desired.

The hydrofoil 10 can be made out of any number of different materials. It is preferable that the hydrofoil not be too heavy and can be solid or hollow depending upon materials of construction. The hydrofoil, for example, can be made of wood, aluminum, plastic, or other suitable material. The hydrofoil 10 can be made of a single material with the apertures 48 and 50 formed directly in the material. Alternatively, the hydrofoil 10 can be a multi-piece assembly with a more rigid portion, such as metal in which the apertures 48 and 50 are formed with the remainder being another material, for example, plastic.

Although one embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit and scope of the invention.

I claim:

1. An apparatus for use on a pool brush, the pool brush having a handle with a pair of opposed holes formed therein and a pair of engagement pins extending through the opposed holes, comprising:

a hydrofoil having a leading edge and a trailing edge, the hydrofoil defining a notch to receive a portion of the handle and including engagement pin receiving apertures receiving portions of the engagement pins therein pivotally mounting the hydrofoil on the pool brush.

2. The apparatus of claim 1 wherein the notch is positioned near the leading edge of the hydrofoil.

3. The apparatus of claim 1 wherein at least one of the engagement pin receiving apertures extends to an opening in the foil permitting an object to be inserted in the engagement pin receiving aperture to move the engagement pin out of engagement with the hydrofoil to remove the hydrofoil from the pool brush.

4. The apparatus of claim 1 wherein the pair of engagement pins are formed on a nylon piece having a first resilient arm and a second resilient arm, the resilient arms each mounting one of the engagement pins.

5. The apparatus of claim 1 wherein the pool handle has a second pair of opposed holes, a brush head removably attached to the handle at the second pair of opposed holes.

6. A method for cleaning the walls of a pool with a pool brush having a handle and a brush head, the handle having a pair of opposed holes formed therein, comprising the steps of:

inserting a resilient piece in the handle having a pair of engagement pins, each engagement pin passing through one of the opposed holes;

inserting the handle into a notch on a hydrofoil to engage each of the engagement pins with an engagement pin receiving aperture in the hydrofoil to pivotally attach the hydrofoil to the brush handle; and moving the pool brush along the wall of the pool to alternately pivot the hydrofoil between positions creating a fluid force urging the brush head against the side of the pool to facilitate cleaning.

7. The method of claim 6 further comprising the step of inserting an elongate object in a passage connected to one of the engagement pin receiving apertures to move the engagement pin out of engagement with the engagement pin receiving aperture to remove the hydrofoil from the pool brush.

8. The method of claim 6 wherein the handle has a second pair of opposed holes formed therein, the method further comprising the step of installing the brush head on the handle at the second pair of opposed holes.

9. The method of claim 6 further comprising the step of installing the brush head on the handle at said pair of opposed holes with said resilient piece.

* * * * *